US006900717B2

(12) United States Patent
Timashov et al.

(10) Patent No.: US 6,900,717 B2
(45) Date of Patent: May 31, 2005

(54) BOBBIN FOR HYBRID COILS IN PLANAR MAGNETIC COMPONENTS

(75) Inventors: Alexander Timashov, Rehovot (IL); Amos Siksik, Lod (IL)

(73) Assignee: Payton LTD, Rishon Lezion (IL)

( * ) Notice: Subject to any disclaimer, the term of this patent is extended or adjusted under 35 U.S.C. 154(b) by 0 days.

(21) Appl. No.: 09/949,602

(22) Filed: Sep. 12, 2001

(65) Prior Publication Data

US 2002/0057178 A1 May 16, 2002

(30) Foreign Application Priority Data

Nov. 15, 2000 (IL) ..... 139714

(51) Int. Cl.[7] ..... H01F 27/30

(52) U.S. Cl. ..... 336/208; 336/200; 336/192; 336/90

(58) Field of Search ..... 336/208, 61, 90, 336/192, 198, 200

(56) References Cited

U.S. PATENT DOCUMENTS 5,929,734 A * 7/1999 Weiner ..... 336/61
6,046,663 A * 4/2000 Kubomura et al. ..... 336/198

FOREIGN PATENT DOCUMENTS

GB 2261868 A * 6/1993 ..... H01F/5/02

* cited by examiner

*Primary Examiner*—Elvin Enad
*Assistant Examiner*—Jennifer A. Poker
(74) *Attorney, Agent, or Firm*—Eitan, Pearl, Latzer & Cohen Zedek, LLP

(57) ABSTRACT

A bobbin for hybrid coils in planar magnetic components including an outer bobbin component configured to hold planar magnetic circuits and an inner bobbin component configured to hold a conventional winding of a multitude of substantially round-section insulated conductor wires.

5 Claims, 4 Drawing Sheets

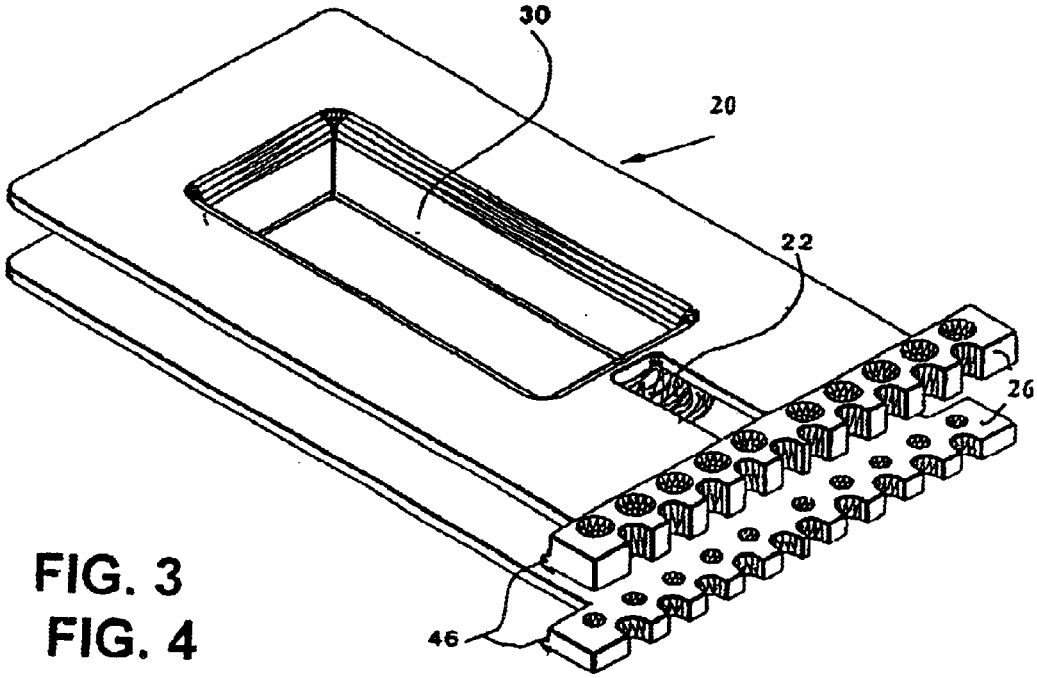
FIG. 3
FIG. 4
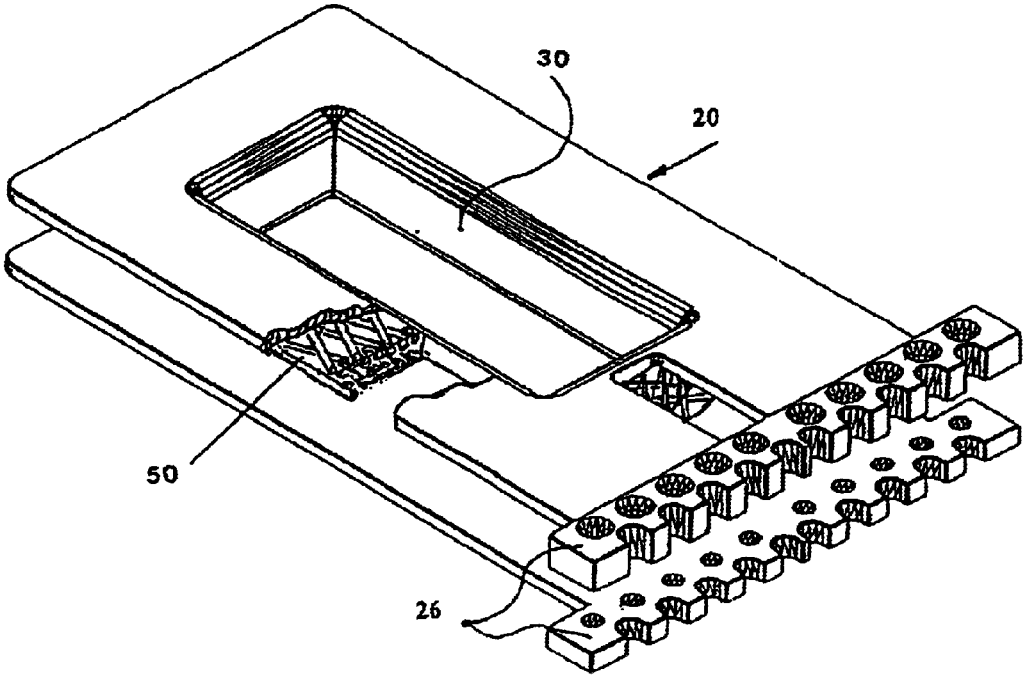

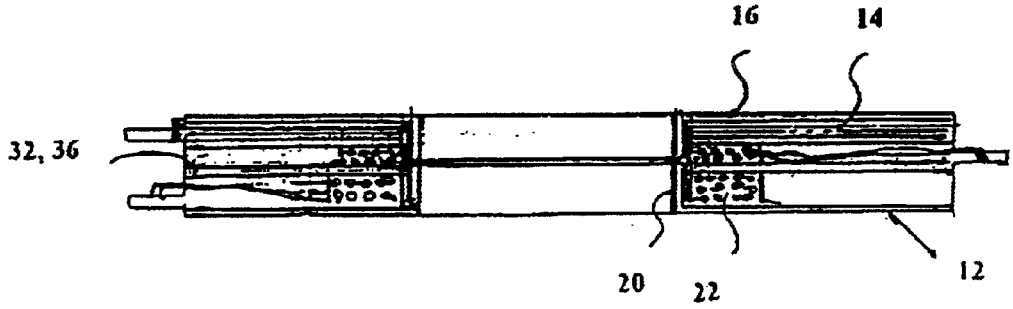
FIG. 5
FIG. 6
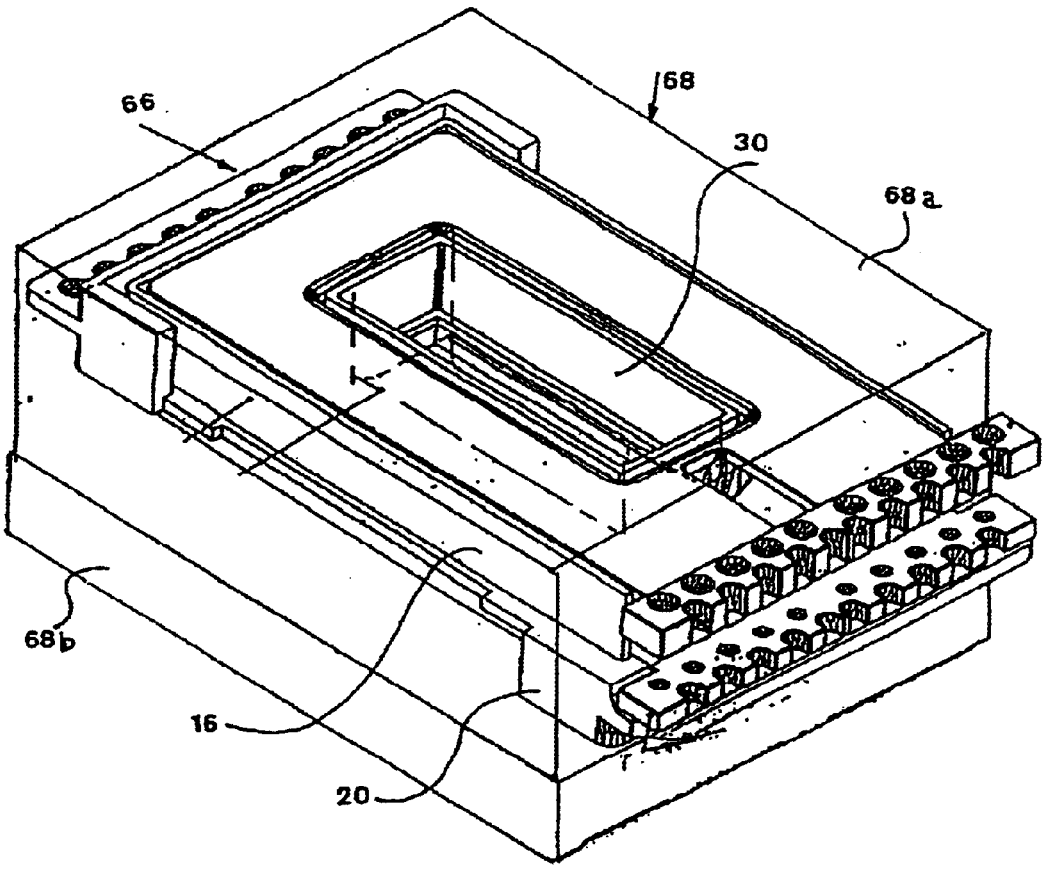

BOBBIN FOR HYBRID COILS IN PLANAR MAGNETIC COMPONENTS

CROSS-REFERENCE TO RELATED APPLICATIONS

This application claims priority of Israeli application serial number 139714, filed on Nov. 15, 2000.

FIELD OF INVENTION

The present invention relates to small magnetic components.

More particularly, the invention provides a bobbin particularly useful for construction of a high turns ratio transformer to be operated at high frequency. The bobbin is intended for the support of two windings, a first winding being planar and a second conventional winding being made of insulated, wound, usually round-section wire. The bobbin is also is useful for operation at low frequencies for high turns ratio applications, for example in AC/DC power supplies.

BACKGROUND OF THE INVENTION

Coil bobbins, usually made of non-conducting material, support a winding or windings which are used in magnetic components such as solenoids, inductive chokes and transformers.

In high frequency transformers the number of turns required in a first section of a transformer, which will be referred to as the secondary winding, is often low—sometimes as few as 1–5 turns meet operational requirements. However the number of turns required in a second section of the transformer, which will be referred to as the primary winding, can be considerably higher, possibly around 100 turns, depending on the input/output voltages to be used and to be produced. Current in the primary winding is usually low.

Where only a small number of turns are required, planar components or lead frames can be used to achieve several important advantages.

Planar components for the present purpose are coils which have been manufactured by Printed Circuit Board (PCB) technology. Such components are often double sided. Various planar circuits are used, and reference is made to U.S. Pat. No. 5,010,314 by the present assignees for fill description thereof.

Lead Frames are coil spirals made by cutting or etching a thin copper sheet.

Both types of planar component, in comparison with conventional coils, allow easy and fast assembly of a coil;

decrease skin and proximity effects;

demonstrate excellent thermal performance and can carry a heavy current;

facilitate good production repeatability and so have consistent properties; and improve magnetic coupling and reduce the leakage inductance.

Examples of bobbin construction known in the prior art are seen in several U.S. patents. In U.S. Pat. No. 4,257,027 Yasuhisa discloses a transformer bobbin assembly. The device has a rectangular inner drum and an outer drum; the two components can be assembled to each other. The outer drum can be opened to facilitate assembly therein of the inner drum, and the design is claimed to ensure a constant distance between the primary and secondary coils. The bobbin is configured to use round section wire coils on both drums.

Harwood in U.S. Pat. No. 4,980,664 adds a shroud to a length-divided bobbin to improve safety factors. The bobbin is configured to use round section wire coils on both sides of the divider.

U.S. Pat. No. 5,010,314 to Estrov refers to a low-profile planar transformer for use in off-line switching power supplies. The construction comprises stacking all the planar components required in a sandwich-like laminate, whereafter core pieces are positioned externally. Planar coils and insulation are used, and there are no conventional coils.

The novelty of the transformer bobbin proposed by Shibui et al. in U.S. Pat. No. 5,321,572 comprises mainly a detachably mounted container case. Both parts of the bobbin are wound using conventional coils, Ichida et al. in U.S. Pat. No. 5,754,086 disclose a transformer unit comprising a main housing accommodating a coil case which in turn encloses a high-voltage coil and magnetic core. The coil case is filled with an insulating compound. Both coils are made of conventional round-section wire.

Planar circuit coils are formed in the stacked device proposed by Weiner in U.S. Pat. No. 5,929,734. This patent was in dispute and was reregistered as belonging to the present assignees. The invention is primarily concerned with terminal pins for connection to printed circuit boards. There are no conventional coils.

Kubomura et al. proposes a side-by-side formation for the coils in U.S. Pat. No. 6,046,663. A novelty is the use of wound steel core around each bobbin coil. The coils themselves are conventional wire wound.

U.S. Pat. No. 6,072,380 to Monroe describes a bobbin-wound current sense transformer wherein a U-shaped staple functions as a one turn primary winding. The secondary winding is of conventional design. The transformer is not height-compact. The single coil may be insufficient for many applications.

Prior art transformer bobbins do not achieve the many advantages offered by planar construction due to the fact that such bobbins are unsuitable where a transformer requires besides the printed circuit windings also a winding with a large number of turns.

DESCRIPTION OF EMBODIMENTS OF THE INVENTION

It is therefore one of the objects of the present invention to obviate the disadvantages of prior art transformer bobbins and to provide a bobbin, and a transformer using said bobbin, which utilizes both planar and conventional coils, each to its best advantage. It is a further object of the present invention to propose a bobbin design allowing the use of a conventionally wound inner bobbin component in combination with an outer bobbin designed for use of planar circuits.

SUMMARY OF THE INVENTION

The present invention achieves the above objects by providing a bobbin for a hybrid planar magnetic component, comprising a) an outer bobbin component including at least two substantially parallel planar surfaces configured to hold planar magnetic circuits comprising between one and twenty coils; and b) an inner bobbin component configured to hold a conventional coil of a multitude of substantially round-section insulated conductor wires, said inner bobbin being shaped for assembly between said at least two planar surfaces of said outer bobbin.

In a preferred embodiment of the present invention there is provided a bobbin assembly wherein the inner bobbin is arranged to accept Litz wire constructed of individual film-insulated conductors, bound together with a strand of insulating material.

In a most preferred embodiment of the present invention there is provided a transformer comprising a) an outer bobbin component holding planar magnetic circuits provided with between one and twenty different windings;

b) an inner bobbin component holding a conventional winding of a multitude of round-section insulated conductor wires, said inner bobbin being shaped for assembly into a space provided at least partially inside said outer bobbin; and c) a ferrous core element magnetically connecting the two bobbins.

Yet further embodiments of the invention will be described hereinafter.

It will thus be realized that the novel hybrid bobbin of the present invention serves to utilize each type of coil in its most appropriate manner. Where only a few turns are required, planar circuits are used with all their attendant advantages. Where numerous turns are needed, conventional round copper wire turns are employed.

As is well known, safety standards, of varying stringency according to country of origin, apply to transformers. Said standards are mainly concerned with the prevention of high voltage leakage into the low voltage circuit. An important advantage achieved by the present invention is the increase in creepage distance between the primary winding to the secondary winding and to the central ferrite core.

Furthermore, according to UL and some other standards, the inner bobbin is classified as a "Minor insulation component". Such classification translates into less stringent insulation requirements and thus opens up options for the use of lower cost materials or thinner wall thickness.

A further feature of the present invention which also improves safety is the use of Litz-type wires for the wound coil. Litz-type wires are constructed of individual film-insulated wires bound together with a strand of insulating material in a uniform pattern of twists and length of lay. Such an insulating strand used on the outside of the wound Litz winding serve to increase the creepage distance between the primary and any other windings wound in same bobbin with the primary, or between primary to secondary windings, also to ferrite core and so are helpful in meeting the various safety standards referred to previously.

It is to be noted that there are applications wherein the secondary winding has the greater number of turns. Obviously, in such a transformer it is the primary winding which is according to the present invention to be composed of planar circuits.

The invention will now be described further with reference to the accompanying drawings, which represent by example preferred embodiments of the invention. Structural details are shown only as far as necessary for a fundamental understanding thereof. The described examples, together with the drawings, will make apparent to those skilled in the art how further forms of the invention may be realized.

BRIEF DESCRIPTION OF THE DRAWINGS

FIG. 3 is a perspective view of an inner bobbin, arranged for "snap in" fit to an outer component;

FIG. 4 is a perspective view of an inner bobbin, arranged to carry "Litz" type wires;

FIG. 5 is a cross-sectional view of an embodiment arranged to carry 3 separate windings; and FIG. 6 is a perspective view of a transformer utilizing the bobbin shown in FIGS. 1 and 2.

DETAILED DESCRIPTION OF PREFERRED EXEMPLARY EMBODIMENTS

Figure 1:
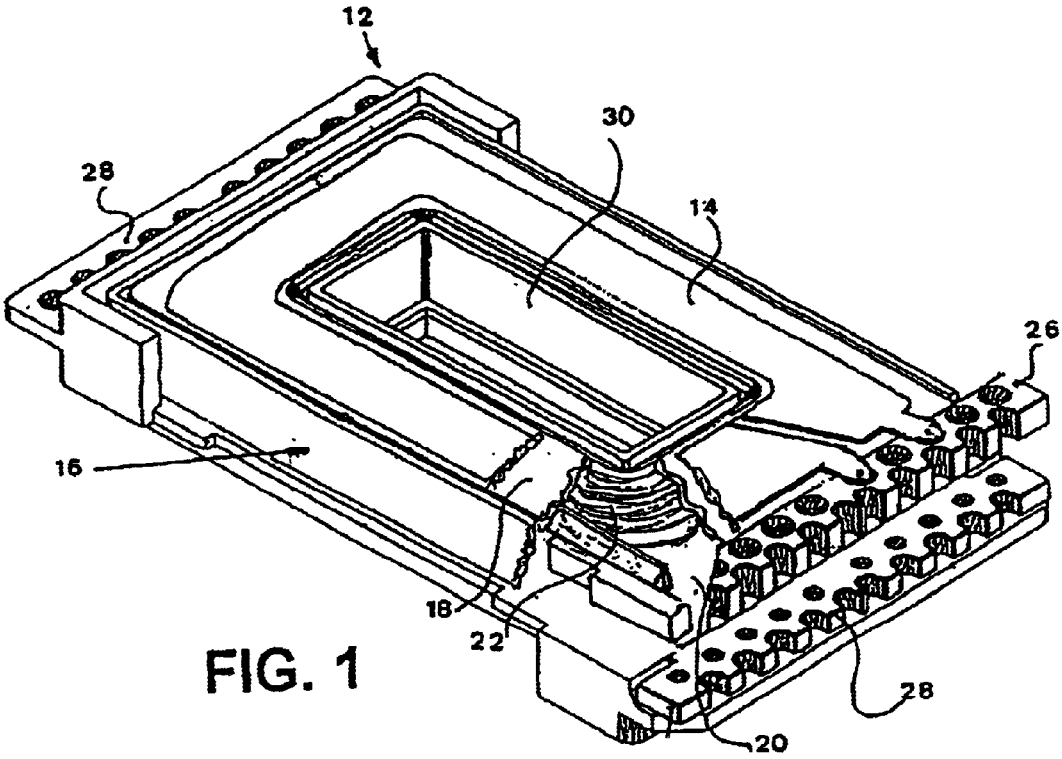
FIG. 1 is a perspective fragmented view of a preferred embodiment of the bobbin according to the invention, showing planar and conventional coils assembled thereto.
Figure 2:
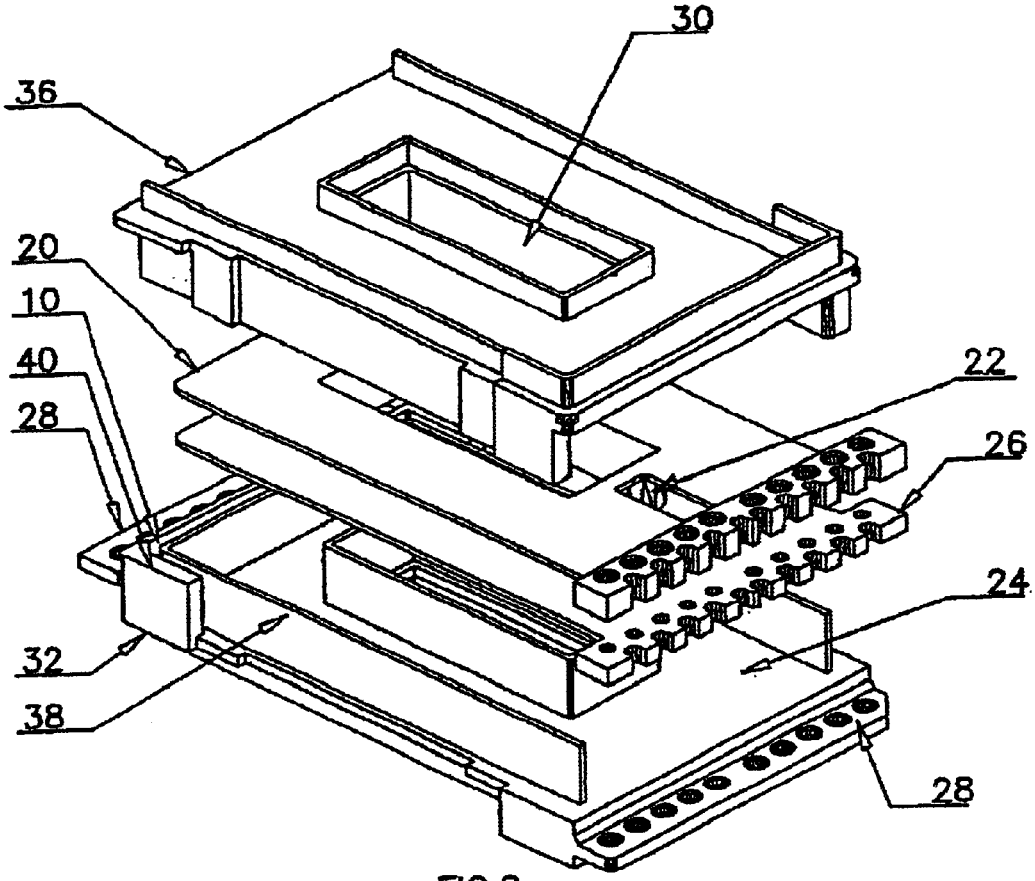
FIG. 2 is an exploded view of the same embodiment, shown before coils are assembled thereto.

There is seen in FIGS. 1 and 2 a bobbin for a hybrid coil of a planar magnetic component. An outer bobbin component 16 is configured to hold planar magnetic circuits produced by printed circuit board technology; FIG. 1 shows the height-compact construction achieved by the assembly 12, and also shows planar windings 14 in the outer bobbin 16. Planar circuits are suitable if the number of required turns in a winding is relatively small. Multiple turns can be produced by etching the appropriate shape on the board 18, by using the reverse side of the board 18 and by using several stacked boards. The outer and inner bobbins 16, 20 are suitably made of a plastic having good thermal and electrical resistance, for example Nylon, Polyesters etc.

The inner bobbin 20 is shaped for assembly into a space 24 provided partially inside the outer bobbin 16.

The space within the inner bobbin could accommodate one or more additional bobbins one within the other.

Terminal strips 26, 28 are provided for both bobbins. Terminals from any layer can readily be interconnected with terminals from another layer by the use of metal pins; the provision of terminals well exceeding the minimum number of four required by any transformer makes such interconnections possible.

The rectangular aperture 30 seen in the center of the assembly 12 is reserved for later use by the ferrite core—seen in FIG. 6—which is part of most magnetic components when completed.

In the construction form illustrated, and best seen in FIG. 2, three inter-fitting moldings 32, 20, 36 are used to provide exceptionally good insulation for the central inner coil 22, which is usually the high voltage section. A lower base tray 32 has inner and outer walls 38, 40 leaving a space 10 therebetween. The inner bobbin 20 fits into inner walls 38.

An upper tray 36, similar to the lower tray 32, has walls which fit into space 10. Planar circuits 14 can be loaded into either the upper or the lower tray 36, 32. The inner coil 22 is insulated from the outside and from the inner rectangular space 30 by at least two walls each provided by a different component to boost safety.

With reference to the rest of the figures, similar reference numerals have been used to identify similar parts.

FIG. 3 illustrates an inner bobbin 20 provided with integrally molded terminal strips 26 which fit into and engage the terminal strips 28 of outer bobbin 16 seen in FIG. 1. In order to provide a "snap in" assembly fit, small projections 46 are added which fit into corresponding grooves (not seen) in the outer bobbin 16.

Advantageously the inner bobbin 20 is sized and shaped to be assembled into an unaltered prior-art outer bobbin.

Seen in FIG. 4 is an inner bobbin 20 arranged to accept woven wire 50 constructed of individual film-insulated conductors referred to as "Litz Wire". As the material—e.g. Polyethylene Terrephthalate—used for bonding individual film-insulated wires is also an insulating material, yet a further safety barrier is formed by this material. The multi-strand configuration minimizes power losses otherwise encountered in a solid conductor due to the skin effect, i.e. the tendency of high-frequency current to concentrate on the conductor surface.

Referring now to FIG. 5, there is depicted a hybrid multi winding bobbin 12 for a planar magnetic component.

An outer bobbin component 16 is configured to hold planar magnetic windings 14 comprising between one and twenty windings.

An intermediate bobbin component 32, 36 is shaped for assembly into a space provided at least partially inside the outer bobbin 16.

An inner bobbin component 20 is configured to hold a wire conventional winding 22 of a multitude of round-section insulated conductor wires. The inner bobbin 20 is shaped for assembly into a space provided at least partially inside the intermediate bobbin 32, 36. The multi-winding construction can be utilized in the construction of a compound transformer. FIG. 6 shows a transformer 66 which has been constructed using the bobbins 16, 20 described wit reference to FIGS. 1 & 2.

A ferrous core element 68 magnetically connects the coils of the two bobbins.

The ferrous core 68 is divided into an upper "E" section 68*a* and a lower "I" section 68*b*. The section 68*a* fills the rectangular aperture 30. Equally a double "E" core may be used.

The scope of the described invention is intended to include all embodiments coming within the meaning of the following claims. The foregoing examples illustrate useful forms of the invention, but are not to be considered as limiting its scope, as those skilled in the art will readily be aware that additional variants and modifications of the invention can be formulated without departing from the meaning of the following claims.

We claim:

1. A bobbin for a hybrid planar magnetic component, comprising:

an outer bobbin component including at least two substantially parallel planar surfaces configured to hold planar magnetic circuits comprising between one and twenty coils; and an inner bobbin component configured to hold a conventional coil of a multitude of substantially round-section insulated conductor wires, said inner bobbin being shaped for assembly between said at least two planar surfaces of said outer bobbin.

2. The bobbin as claimed in claim 1, wherein said inner bobbin is provided with integrally molded terminal strips which fit into and engage the terminal strips of said outer bobbin to provide a "snap in" assembly fit.

3. The bobbin as claimed in claim 1, wherein said inner bobbin is arranged to accept woven wire constructed of individual film-insulated conductors.

4. The bobbin as claimed in claim 1 wherein the space between said two substantially parallel planar surfaces is adapted to accommodate one or more additional bobbins one within the other.

5. A magnetic component comprising a) an outer bobbin component including at least two substantially parallel planar surfaces holding planar magnetic circuits provided with between one and twenty coils;

b) an inner bobbin component holding a conventional coil of a multitude of usually round-section insulated conductor wires, said inner bobbin being shaped for assembly between said at least two planar surfaces of said outer bobbin; and c) a ferrous core element magnetically connecting the coils of said two bobbins.

* * * * *